United States Patent [19]

Potter

[11] 4,013,201

[45] Mar. 22, 1977

[54] FATIGUE REDUCING BACKPACK HARNESS

[76] Inventor: Glenn James Potter, 1332 S. Hope St., No. 302, Los Angeles, Calif. 90015

[22] Filed: Jan. 26, 1976

[21] Appl. No.: 652,466

[52] U.S. Cl. ..... 224/25 A; 224/8 A

[51] Int. Cl.[2] ..... A45F 3/14

[58] Field of Search ..... 224/25 A, 48 F, 6, 8 R, 224/8 A, 9, 10

[56] References Cited

UNITED STATES PATENTS

| | | | |
|---|---|---|---|
| 924,133 | 6/1909 | Blake | 224/48 F X |
| 3,355,075 | 11/1967 | Dean | 224/25 A |
| 3,504,405 | 4/1970 | Elliott-Smith | 224/25 A |
| 3,733,017 | 5/1973 | Pletz | 224/8 R |
| 3,921,867 | 11/1975 | Farnbach | 224/25 A |

*Primary Examiner*—Robert J. Spar
*Assistant Examiner*—Donald W. Underwood

[57] ABSTRACT

A shoulder piece, adjustably bolted to side bars, includes a latch controlling the height of a notched stem extending upward surmounted by a clamp holding a horizontal tube on which are mounted a pair of padded shoulder hooks made from flat strips of light resilient metal given an arch. Another shoulder piece, alternatively, has on the upper crosspiece of the frame two clamps, each tightened by two bolts with wing nuts for receiving and adjustably holding the flat back ends of the shoulder hooks. Flexible straps with quickly adjustable buckles join the front ends of the hooks with the frame down low. A padded C-shape of resilient metal the curve of which is controlled by a flexible belt and buckle closing the gap forms a weight-bearing hip piece, pivotally joined in back to the lower crosspiece of the frame, the motion restricted to rocking with up and down movements of the hips.

6 Claims, 5 Drawing Figures

FATIGUE REDUCING BACKPACK HARNESS

Figure 1:
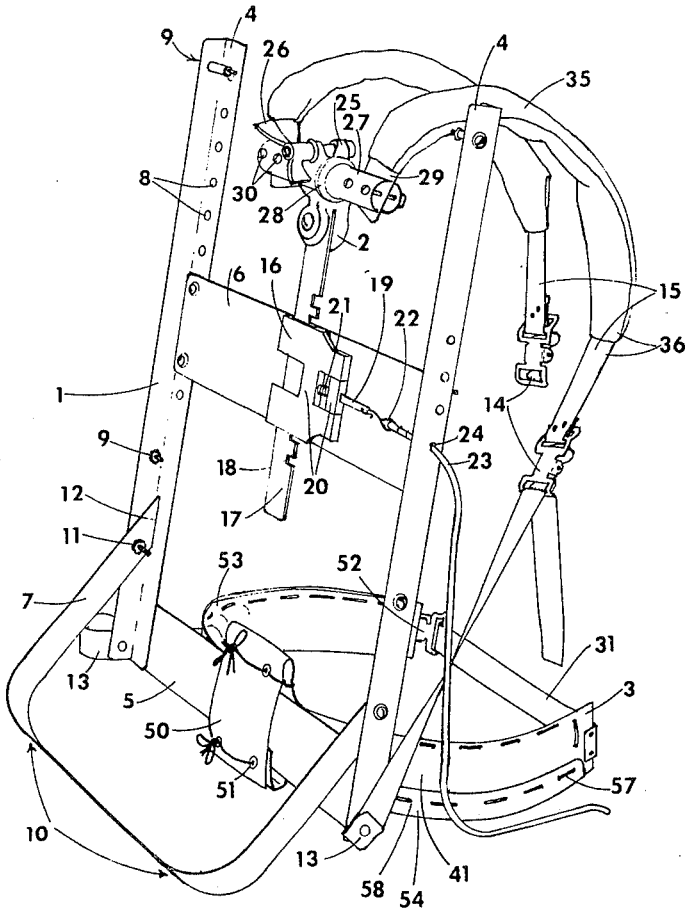

For tens of thousands of years, people have carried food, equipment, and babies on their persons as they engaged in hunts, explorations, migrations, wars, and recreational activities; they are still seeking ways to make the burdens comfortable. The load may be heavy when high peaks are to be assaulted. The backpack must be fitted over heavy clothing in the cold and in space, and be refitted over light clothing for use during the heat of the day. The shoulders must be left free during alpine rock climbs and when a walking stick is used.

The art has evolved from the shapeless bag which rubbed against the body and was held by a shoulder strap, through improvements in which double shoulders straps and a belt were employed, and on to modern modifications having frames and low belts which shift part of the weight to the pelvic girdle. The western world rejects balancing the load on the head, an unsuitable method anyway when the trail leads through thickets or up steep inclines. Forehead straps require too much forward bending. A multitude of partial solutions aimed at amelioration of the inherent disadvantages of the backpack have been patented, far too many for instant review; I have worked out several additional solutions as reported on herewith.

An object of my invention in backpack frames and body attachments is to provide quick convenient adjustments of the fit as changes in weather and ambient temperature require jackets and rain gear to be put on or removed.

Another object is to have the pelvic girdle bear the major portion of the load when desired, yet to be spared at the expense of the shoulders at other times and to vary degrees, so as to relieve regional tiredness and related problems.

Another object is to provide weight-bearing by the hips even when their rocking movements are exaggerated during rock climbs or when the upgrade or downgrade is steep; a special post-sacral pivot means accomplishes this. A related object, inherent in this pivot means, is to allow free motion of the hips at all times, postponing tiredness and adding enjoyment to the hike.

Yet another object is to hold the upper part of the load forward by pressure applied high in front and near the mid-line on the chest by fully adjustable, shaped, semi-rigid shoulder hooks, while allowing freedom of motion of the shoulders as needed during rock climbs, when a walking stick or staff is used, and just to prevent regional tiring and its aftermath, generalized fatigue with loss of impulse to go on.

Still another object is to eliminate a tight constrictive fit at shoulders and hips with consequent early tiring and related problems, and at the same time to provide enough slippage at the contacts of the frame and its paddings with the clothing that the short-legged long-stepper can twist the pelvis freely on the torso with each step.

The mobility of the shoulder girdle in the human is pointed up by the fact that it has only two joints of attachment to the rest of the skeleton - at the inner ends of the clavicles; only by tonus of the trapezius and other muscles is the weight of the arms and of burdens carried. Tiring may come on quickly. Another object is to non-constrictively support, closely beside the neck, that portion of the weight not borne by the pelvic girdle, utilizing the trapezius muscles, (where carpenters rest planks being carried), avoiding application farther out laterally where adverse leverage would cause early tiring, and shoulder movements would be interfered with.

Analysis of walking reveals its complexity. Certain features are relevant to the construction and fitting of backpacks. A neglected feature of design, which I have sought to correct, is accommodation to the rocking motion of the pelvis with each step in models bearing seriously on that region. My hip girdling member is pivoted to the vertical frame behind the sacrum. Flexible pelvic belts do not distribute weight effectively anteriorly to their mountings on the frame, so I have made a pivot housing accommodating a relatively stiff and broad C-shaped member which extends far forward and resists yielding upwards at the front. Compression of the glutei and tensors fasciae latae near their origins by a tight flexible belt is tolerated for a considerable period during hiking, but eventually hampers the wearer. Muscles thus compressed must do extra work, and this leads to increased tension, cramping, aching, lameness, and early demand for rest. An autonomic reflex is elicitated leading to arterial vasoconstriction, whereupon the deprived muscles fail to perform, and walking becomes intolerable. This paralyzing effect comes on much sooner in the case of the muscles of the shoulder girdle if harness is constrictive near the insertions of the pectoralis major muscles. An object of the present invention is to overcome the constrictiveness of the customary wholly flexible shoulder straps by replacing them in part with semi-rigid curved hooks controllably mounted on the frame.

Flexible pelvic belts can distribute weight far forward only when cinched up so as to be severely constrictive, but then the reflex fatigue, lameness, and vasoconstriction come on early. A plurality of rapidly made adjustments in the fitting such as I have provided are useful in a design, allowing the wearer to quickly redistribute the weight and prevent or relieve the varying hampering reactions to pressures about shoulders and hips as they occur. The exceptional adjustability of my backpack rack adapts it to a wide variety of individual shapes and proportions, and allows for recovery of regions as tiring occurs by a multiplicity of quickly made readjustments, especially beneficial to the aging hiker, giving him extra years on the trail.

The pelvic member which I designed is a flat broad strip of light resilient material such as hard aluminum, curved in a loosely-fitting C-shape, having the gap in front closed by an adjustable belt, to non-constrictively conform to the size of a particular wearer. In back, at the middle, the strip is not curved, and forms the anterior wall of a flat tunnel which encloses the middle of the flat lower cross-member of the frame proper. These parts lie in the plane of the frame, and the C-piece is held closely against the cross-member by the low tunnel, which, however, is broad enough to allow the C-piece with its attached tunnel to rock on the cross-member upon a pivot. The relation of the plane of the C-piece to that of the frame is maintained at virtually a right angle by this means, enabling the C-piece to distribute the pack's weight as far forward as the anterior superior iliac spines. As will be explained, when the shoulder hooks of one form of the invention are set at the proper downward angle and the frame is properly lengthened by selection of the correct stem notch for the locking bolt, the C-piece reaches below the iliac crests; and it is drawn into a smaller oval by adjustment of the attached strap and buckle until it fits the hips of the particular wearer and is so held. Only the tendency of the C-piece to spring open and becomes too large is opposed by this belt-tightening; this does not involve appreciable constriction of the pelvis or abdominal viscera. It is preferable to pad the undersides of the shoulder hooks and the inside of the C-piece including its post-sacral portion. The alternative embodiment of the C-piece gives it the shape of an incomplete truncated oval cone, larger below, which would give it a better than average fit to lean individuals with full hips. Waterproof fabric or leatherette may be made to cover the paddings, the latter material allowing slightly freer motions for the wearer as the surfaces glide on the clothing.

Problems of the backpack are elucidated in an analogy in which a wall represents the human back and a weighted ladder represents the pack. Laid against a sloping wall, the ladder is stable, as also when leaned against a vertical wall. If the ladder's legs are brought up to the wall, the ladder tips over backwards. If hooks are provided at the top, they will hold it, pressing backward from in front of the wall and not pressing on the top if the ladder's length is adjusted sufficiently. Eliminating the ground to improve the analogy, we can provide forwardly directed prongs on the legs of the ladder, remove bricks to make holes supporting the prongs, and hang the ladder on a high wall. If the prongs are long, bearing weight far forward, backward pressure by the down-curving tips of the hooks is increased, and this will be true even if the ladder is lengthened upward until the hooks bear none of the weight.

In actual hiking, the extreme conditions just pictured, although important to the understanding, are not desirable. To avoid local cramping, tiring, and chafing, ready adjustments should be provided, shifting the load at one time more onto one shoulder or the other, then more off both but onto the hips, by changes made in length of the shoulder and girdle straps, in elevation of the shoulder hook crosspiece, and in the down-slant and degree of curvature of the shoulder hooks, as will appear. Never can backward pressure by the hook tips and their straps be removed as long as the fully erect position is maintained, although it will not increase proportionately as the load is increased if there is some resilient give in the hip-girdling part because the give distributes the weight farther back, just as shortening the prongs would in the ladder analogy.

Figure 5:
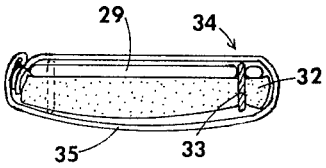
Figure 4:
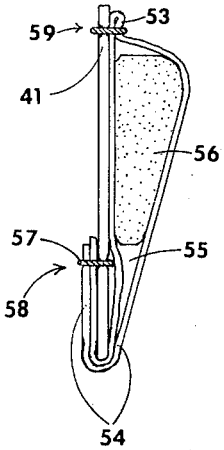
Figure 2:
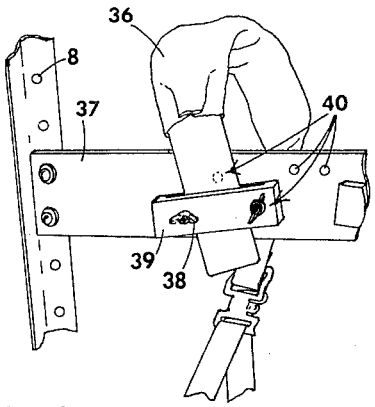
Figure 3:
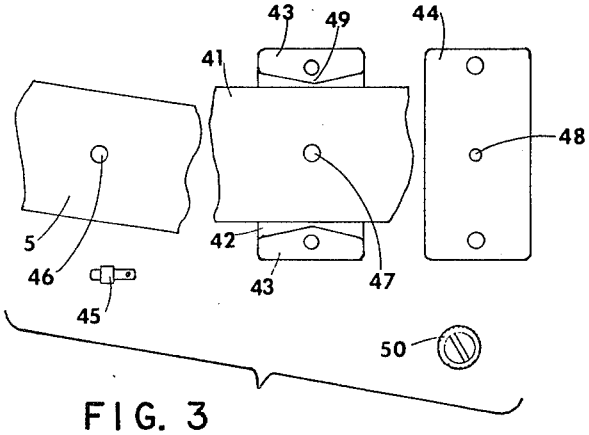

A more complete appreciation of the invention and many of the attendant advantages thereof will be readily apparent as the same becomes better understood by reference to the following description when considered in connection with the accompanying drawings, wherein:

FIG. 1 is a perspective view of one entire embodiment of the backpack rack as seen from the back, above, and the right, FIG. 2 is a fragmentary perspective view from the back, above, and the right, of one embodiment of a left shoulder hook and its adjustable attachment to the frame, FIG. 3 is a view from the rear of the parts of the pivot box, FIG. 4 is a sectional view of an arm of the hip C-piece, about natural size, and FIG. 5 is a sectional view of a shoulder hook, slightly reduced.

With reference to the drawings, particularly FIG. 1, one embodiment of the backpack frame comprises a frame proper 1, a shoulder hooks member 2, and a hip-girdling member 3. The frame proper 1 comprises left and right vertical side bars 4 permanently joined to a lower crosspiece 5; also an upper crosspiece 6; and a foot-piece 7 to make the complete backpack free-standing. Each side bar 4 in the particular embodiment is an L section girder of strong light material such as hard aluminum having a plurality of spaced holes 8 to which the upper crosspiece 6 may be bolted at one of several levels. A pack bag is attachable by conventional means by its grommets at other holes 9 in each side bar. Various special carriers can be attached to my rack so that insecticide sprayers, chain saws, provisions, or children can be transported. A bail-like foot-piece with flattened arch 10 made from flat hard metal is pivotally attached near the lower ends of the two side bars by two bolts with spring washers 11. The ends fits within the girders, extend above the bolts, and are cut diagonally 12 so as to limit the amount of opening-out of the foot-piece from the frame when the backpack is stood upright. The foot-piece is folded flat for shipping and storage, and, as will be shown, the shoulder hooks are rotated downward to further conserve space, while the hip-piece may be dislocated from the frame also. Alternatively, the foot-piece may be rigidly joined to the frame. Near the bottom of the frame, on the side bars or more mesially, two flexible straps 13 are rotatably attached, fitting by their free ends into levered buckles 14 on the free ends of two shoulder straps 15.

Upper crosspiece 6 is bolted to side bars 4 by conventional means at a level chosen according to the length of the trunk of the wearer; it is equipped to support the shoulder hooks member 2 in a special way so that the distance between shoulder hooks and hip member can be altered quickly while the pack is being worn. Upper crosspiece 6 is a broad plate of hard light metal having a strong flat vertically disposed guideway 16 on its back surface, receiving the flat, downwardly-extending stem 17 of the shoulder member. Stem 17 has a plurality of rectangular notches 18 cut into one edge, into which bolt 19 fits. Bolt guideway 20 is in two parts, retaining bolt spring 21 under compression, forcing bolt into any aligned notch. The lateral end of bolt 19 has a hole into which a nearly closed hook 22 fits. The lateral end of said hook is an eye, receiving the looped end of cord 23, which cord runs laterally through hole 24 in the nearby side bar, beyond which said cord is danglingly redundant and easily grasped for resetting bolt 19 in another notch.

Stem 17 ends above in clamp 25 of bicycle handlebar type, having wing nut 26, so that tube 27 may be easily rotated and reset in the clamp without tools. Retaining collars 28 keep tube centered. Each end of tube 27 is slotted for the fastening of the back end of a shoulder hook by two nut-carrying screws 30 passing through and through and threaded into the shoulder hook and the front holes of tube 27. Two extra holes in each slotted region may be provided and the slots may be lengthened (not shown) in order that the shoulder hooks may be mounted closer to the neck for certain small wearers. Each shoulder hook 29 is made of flat hard light metal given a curve, convex upwards. Its shape, properties, and mounting make it relatively resistant to lateral or medial distortion, but is is resilient enough to arch more under loading and when shoulder strap 15 is tightened. Each flexible shoulder strap 15 is pivotally mounted at the front end of its shoulder hook and ends distally in a acting buckle 14, preferably a quickly-acting one embodying a spring loaded, web-gripping, hand-operated lever. It may be seen that during the hike, instant adjustments of the shoulder straps and the hip-piece strap 31 may be conveniently made so as to rest one region and another of the wearer, thus shifting locations of extra weight-bearing around and allowing the hiker to increase his range. Furthermore, lowering or raising the front ends of the shoulder hooks by readjustments of the tube position in the clamp can alter how much of the load will be borne by the trapezius muscles, and can reduce excess pressure against the front of the chest. Help from a companion can accomplish this adjustment and also reset the bolt another notch of the stem quickly while the pack remains on the wearer.

As shown in FIG. 5, each shoulder hook is padded on its underside, with felt for instance, the padding 32 being held in place by stitch-laces 33 passing through a plurality of small holes 34 in staggered rows near the two edges of the shoulder hook. A tube of waterproof cloth or leatherette 35 is slipped over each padded shoulder hook; the tube ends are tucked in and drawn smaller by stitching.

As illustrated in FIG. 2, the shoulder hooks member 36, alternatively, in another embodiment, is made lighter and more simply by the fixation of the shoulder hooks directly to the upper crosspiece 37. Shoulder hook alternative 36 is fixed in a selected position to crosspiece 37 by tightening of wing nuts 38 on their bolts against plate 39, which has its ends built up to almost the thickness of the shoulder hook material. A plurality of fitting holes 40 for the bolts with wing nuts allows for adjustment of slope and spacing, improving individual fit. Mesial ends of the clamps may be given a bias to fit them closer together. Shoulder hooks of various curvatures may be inserted.

As shown in FIGS. 1 and 3, hip-girdling member 3 is chiefly a broad flat plate of hard, light-weight metal curved approximately into a C-shape 41, the middle portion remaining uncurved. A plate 42, thickened at its upper and lower ends 43, is permanently fixed to the front side of the middle of the C-piece 41, and a matching cover plate 44 is removably screwed on at the thickened ends, forming a slot-like open-sided box or tunnel in which the middle of the lower crosspiece 5 of the frame is enclosed, limiting all movement but rocking motion at pivot 45, which is fastened to cover plate 44 and fitted into holes 46, 47, and 48. Spacers 43 do not approach crosspiece when in mid-position and are formed inside into obtuse angles 49, allowing crosspiece 5 to rock relatively on pivot 45 within the limits imposed by the angled upper and lower walls of the box. Knurled heads of screws 50 fastening cover plate 44 have driver slots and a low profile, assisting the fit of waterproof cover 50, see FIG. 1. This flexible, tubular waterproof cover encloses a padding interposed between the sacrum and the hip-piece 3, and its lower ends folds back and up to be covered by its upper end, which folds back, down, and over. A total of four spaced grommets secure the padding, and two more grommets in the lower section of the cover plus four more grommets 51 in the upper, covering, section line up when two short laces or one longer lace are passed through said grommets and tied tightly. The inner surfaces of cover 50 and the four short sections of lacing passing between the padded and the folded-over portions of the cover and passing next the spacers 43 keep the cover centered. Petroleum jelly or other grease lubricates the slot and pivot, and dust is excluded the better while exuding grease is absorbed, by a thin wrap-around piece of felt (not shown), interposed between the pivot box and the waterproof cover. This felt strip may be cut narrower at the pivot box ends and punched out for the knurled knobs, for a better fit and better retention.

A quickly acting levered buckle 52 is attached to one arm of the C-piece 41 in front, and a flexible strap 31 to the other. It can be seen that the hip-girdling member 3 may be given too little curve initially, producing too loose a fit, but that it will receive a sharper curvature and be made to fit the hips of the wearer if the strap is tightened, and without constriction nor strong pressure on the abdomen. As shown in FIGS. 1 and 4, each arm of hip-piece 41 is padded on the lower edge and inside. Each pad consists of a narrow double thickness flange of waterproof leatherette or fabric above 53, and a wider flange below 54, and a tube integral with said flanges, in between them 55, filled with a strip of padding 56 such as felt, wedge-shaped in cross-section, base up. Each cover is stitched closed around C-piece 41 at both ends. Wide flange 54 is stitch-laced to the outside lower edge of its C-piece arm, the stitches 57 passing through a plurality of small holes 58 near its lower edge. The pad is curled around and brought up on the inside of the curving metal, and stitch-laced by the narrow flange 53 to the upper inside, where another row of small holes 59 is provided near the upper edge. The holes may be staggered to keep the metal strong (not illustrated in FIG. 4).

Alternatively, the C-piece may be given a flare, larger below, making it a short, truncated, incomplete, oval cone, whereupon the padding need not be thicker above.

It will be noted that the shoulder hooks member and frame proper may stay in position on the back while the hip-girdling member pivots freely and follows even extreme rocking movements of the pelvis during climbing, all the while transmitting the pack's weight to the hips to the extent desired; also that the boxing in, about the pivot, of the broad lower crosspiece by the hip-piece resists down-tilting in back of the hip--piece with ordinary loads, allowing the load to be applied widely to the hips, even far forward.

Cover 50 may be alternatively made with two rivets beside the upper end of pivot box 42, 43, & 44 and two snap-fasteners on each side below, or with one or other of these means in combination with grommets and lacing either above or below.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

I claim:

1. An adjustable pack frame assembly for mounting on a person's back for carrying a load thereon, comprising:

a frame proper including right and left side bars rigidly connected near their lower ends to a lower crosspiece, an upper crosspiece to which said side bars are adjustably fastened higher up to accommodate the size of the wearer as by a pair of bolts and wing nuts on each side fitting selected holes in a row along each side bar, and means for attaching a knapsack or other container or burden to said side bars, a stand-up prop making the entire backpack free-standing, consisting of a U-shaped foot piece pivotally attached near its ends to the lower portions of the side bars by two spring-washer loaded bolts, the ends of the arms of said foot piece diagonally shaped terminally beyond the bolts so as to impinge on portions of said side bars and limit unfolding of said foot piece when it is brought far enough back to brace the loaded backpack upright, a shoulder suspension means consisting of:

said upper crosspiece, left and right shoulder hooks, each a strip of flat light-weight hard resilient material such as hard aluminum given a curve convex upward and adjustably fastened to said upper crosspiece canted outward to fit the shoulder, each said hook padded on the underside, the pad secured to said hook by stitch-lacing whereby a strong strand or multiple strong strands are passed as stitches through the pad then as lacing through rows of small holes alongside the edges of the hard material, said rows being staggered to conserve hook strength, and said hook covered with a tubular waterproof material such as leatherette and having its ends made small and snug by tucking and/or purse-stringing, two flexible straps pivotally attached to the forward ends of said shoulder hooks and ending in quickly-adjustable levered buckles, and two flexible straps, each pivotally secured low and laterally on said frame and engageable in a said shoulder hook buckle for stabilizing the load and modifying the curvature of said shoulder hook for best fit, a hip-girdling member for carrying a substantial portion of the load, consisting of:

a broad flat semi-rigid plate such as hard aluminum formed into a C-shape except where remaining flat in its mid-portion behind whereon is rigidly attached close to its back (outside) by one or more spacers a broad plate forming a broad narrow vertical slot into which the flat broad mid-portion of the lower crosspiece of the frame fits and wherein it is free to relatively rock with the vertical motions of the hips during walking, climbing, or cycling, on a removable pivot running horizontally through the middle of the assembly, limited by impingement of the crosspiece on said spacer or spacers, a quickly-adjustable levered buckle and strap means for completing the hip-girdling C-piece in front and non-constrictively fitting that member to the user's upper pelvis, a pad, waterproof on the outside, for the lower edge of and the inside of each arm of the semi-rigid C-piece, said pad being thicker along the top and of a curving wedge-shape and extending upward as a thin narrow flange, also downward similarly as a thin broad flange to curl around the lower edge of said C-piece, said flanges being secured by the said stitch-lacing technique to said C-piece in two rows of staggered holes, a fitted wrap-around waterproof cover for the pivot means bearing inside a post-sacral pad in its front portion and enclosing a grease-absorbing dust cover, said waterproof cover made in the form of a flexible flattened tube having grommets along its sides so it can be laced on the hip-girdling member at the back around said pivoted deep slot means, the laces when drawn and tied holding said waterproof cover in position;

2. The adjustable pack frame assembly as described in claim 1, wherein said shoulder suspension means includes a flat stem extending vertically in a guide way behind and against said crosspiece, having a plurality of rectangular notches along one edge for engagement of a spring-loaded bolt operated in a horizontal guideway on said crosspiece by a tug line for the hand, a clamp rigidly connected to the top end of said stem, and shoulder hooks, canted to the slopes of the shoulders and adjustably joined to a horizontal tube by bolts in slots, said tube itself adjustably fastened in said clamp and rotatable to lower and raise the front ends of said shoulder hooks and thus aid in fitting various figures quickly and comfortably;

3. The adjustable pack frame assembly as described in claim 1, wherein, said shoulder suspension means includes a pair of clamps, one for each shoulder hook, thickened at each end to almost the thickness of said shoulder hook material, and long enough to allow for their side play, boltable to said crosspiece by two bolts, one near each end of each clamp, passing through a selected pair of a plurality of sets of holes in said crosspiece, tightened by wing nuts so as to clasp firmly the inserted flat vertically disposed back ends of said shoulder hooks adjusted for best fit, whether raised or lowered more, separated more or moved closer together, and canted more or less;

4. The adjustable pack frame assembly as described in claim 1, wherein said broad narrow vertical slot consists of a pivot box having a removable cover plate behind the lower crosspiece, pierced for said pivot and with attachment means for it, and said cover held to a spacer above and one below, also to the C-piece by two low-profile knurled and driver-slotted screws, said spacers formed in obtuse angles to broadly limit rocking of said C-piece on said cross-piece;

5. The adjustable pack frame assembly as described in claim 1, wherein said C-piece is flared below at the sides to better fit some hips, resembling a short truncated irregular oval cone's surface;

6. The adjustable pack frame assembly as described in claim 1, wherein said waterproof cover is fastened to itself above at the sides by through-and-through rivets and closed below at the sides by snap fasteners, or wherein these means in part combined with grommets and laces are used variously to fasten the same waterproof cover.

* * * * *